United States Patent [19]

Sarcia

[11] 4,310,337

[45] Jan. 12, 1982

[54] CRYOGENIC APPARATUS

[75] Inventor: Domenico S. Sarcia, Carlisle, Mass.

[73] Assignee: Oerlikon-Buhrle U.S.A. Inc., New York, N.Y.

[21] Appl. No.: 185,563

[22] Filed: Sep. 9, 1980

Related U.S. Application Data

[63] Continuation-in-part of Ser. No. 89,274, Oct. 29, 1979.

[51] Int. Cl.[3] ..... F25B 9/00

[52] U.S. Cl. ..... 62/6; 137/625.37

[58] Field of Search ..... 62/6; 137/625.37

[56] References Cited

U.S. PATENT DOCUMENTS

| | | | |
|---|---|---|---|
| 2,906,101 | 9/1959 | McMahon et al. | 62/6 |
| 2,966,035 | 12/1960 | Gifford | 62/6 |
| 3,119,237 | 1/1964 | Gifford | 62/6 |
| 3,188,821 | 6/1965 | Chellis | 62/6 |
| 3,218,815 | 11/1965 | Chellis et al. | 62/6 |
| 3,421,331 | 1/1969 | Webb | 62/6 |
| 3,600,903 | 8/1971 | Chellis | 62/6 |
| 3,609,982 | 10/1971 | O'Neil et al. | 62/6 |
| 3,620,029 | 11/1971 | Longsworth | 62/6 |
| 3,733,837 | 5/1973 | Lobb | 62/6 |
| 3,788,088 | 1/1974 | Deehne | 62/6 |
| 3,853,146 | 12/1974 | Blair | 137/625.37 |
| 4,108,210 | 8/1978 | Luthe et al. | 137/625.37 |

*Primary Examiner*—Ronald C. Capossela
*Attorney, Agent, or Firm*—Schiller & Pandiscio

[57] ABSTRACT

A cryogenic refrigerator is disclosed which features a novel combination of displacer and refrigerant flow control means. The displacer comprises two sections, with one displacer section being arranged to vary the volume of a first chamber as the displacer undergoes reciprocating motion, and the other displacer section being arranged to vary the volume of a second chamber during the same motion. The first and second chambers, which serve as working chambers from the standpoint of achieving refrigeration, are connected by first and second heat exchangers and first and second thermal regenerators respectively and a flow control means to high and low pressure sources of refrigerant fluid. The flow control means comprises a slide valve which is movable by the displacer and coacts therewith to control movement of refrigerant into and out of the first and second working chambers as their volumes change with movement of the displacer.

21 Claims, 6 Drawing Figures

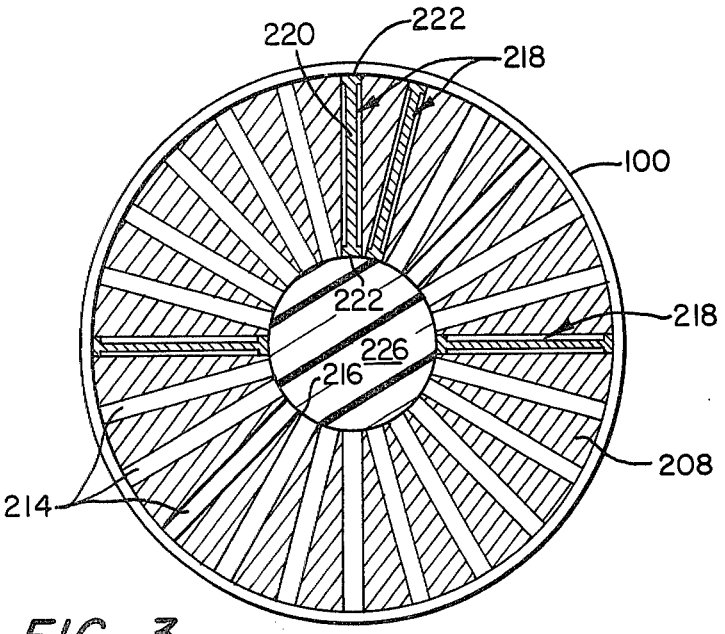
FIG. 3
FIG. 5
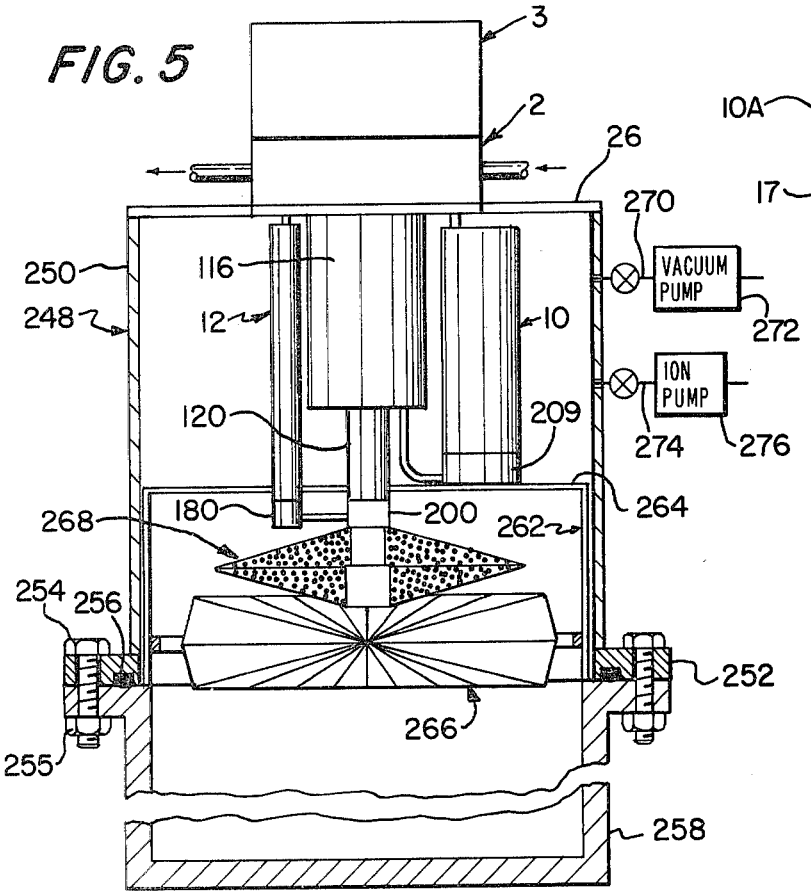
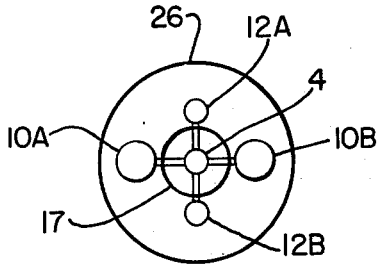
FIG. 4

CRYOGENIC APPARATUS

This is a continuation-in-part of my copending Application Ser. No. 089,274, filed Oct. 29, 1979 for Cryogenic Apparatus.

This invention relates to cryogenic refrigeration and more specifically to an improved form of cryogenic refrigerators.

BACKGROUND OF THE INVENTION

A number of unique refrigeration machines have been developed to satisfy the increasing demand for cryogenic refrigeration. These devices, all based upon the controlled cycling of an expansible fluid with suitable heat exchange to obtain refrigeration, are exemplified by U.S. Pat. Nos. 3,333,433, 3,321,926, 3,625,015, 3,733,837, 3,884,259, 4,078,389 and 4,118,943, and the prior art cited in those patents.

The present invention is directed to an improved form of refrigeration system of the kind which employs a working volume defined in part by a displacer, with the latter arranged to reciprocate so as to cause an increase or decrease of the working volume, valve means for causing a refrigerant fluid to flow into or out of the working volume in accordance with movement of the displacer, and a thermal regenerator through which the refrigerant fluid flows to and from the working volume in accordance with movement of the displacer. Such systems may take various forms and employ various cycles, including the well known Gifford-McMahon, Taylor, Solvay and Split Stirling cycles. In each case the flow of refrigerant and the displacer movement must be controlled continuously and accurately so that the system can operate according to the particular refrigeration cycle for which the system is designed.

Heretofore, various means have been used to achieve the desired refrigeration cycle, including the use of different forms of valving and various means for achieving controlled movement of the displacer. Inevitably, the prior devices have suffered from engineering limitations. In certain cases, the valving employed to control the flow of refrigerant fluid has suffered from one or more of the following: undue complexity of construction, relatively high cost of manufacture, difficulty of adjustment as to operation, relatively short operating life, and suitability only for a small range of refrigeration capacities. Other problems which have plagued prior forms of cryogenic refrigerators having gas-driven displacers have been excessive size of the valving (or of the refrigerator because of the valving construction and/or location), the "slamming" or "banging" of the displacer each time it undergoes direction reversal, low efficiency due to distorted P.V. diagrams, excessive work input or work absorption (e.g. high friction losses), or inability to operate well at the low reciprocating speeds that are preferred for such apparatus. Another equally important limitation of some prior devices is the inability to accommodate, or to accommodate conveniently, dual stages of refrigeration. In this connection it is appreciated that it is old in the art to provide refrigerators with a first refrigeration stage capable of achieving a first selected low temperature, e.g. 77 degrees K, and a second stage connected in series with the first stage and adapted to achieve a second still lower temperature, e.g. 20 degrees K. However, the physical disposition of the heat exchangers which characterize the two stages may be such as to complicate the utilization of the refrigerator in selected applications, e.g. in a cryo pump. Furthermore, design limitations of prior refrigeration equipment may make it difficult or excessively expensive to modify the first or second stage cooling capacities for different applications.

OBJECT AND SUMMARY OF THE INVENTION

It is, therefore, the primary object of this invention to provide a cryogenic apparatus which offers a combination of advantages not achieved at all, or as conveniently or efficiently, by any other cryogenic refrigerator heretofore available.

It is another object of this invention to provide a cryogenic refrigerator which combines the advantages of multiple cooling stages, simple and reliable valving, and suitability for use in dual stage cryo pumps.

A further object of the invention is to provide a new and improved form of slide valve for controlling the flow of refrigerant fluid into and out of the working volume of a cryogenic refrigerator.

Still another object of the invention is to provide a cryogenic refrigerator characterized by a cooling chamber of variable volume and a mode of operation such that the pressure and volume of refrigerant fluid in the cooling chamber change in a manner which results in an efficient refrigeration cycle.

Still other objects of the invention are to provide cryogenic refrigerators which can be made in various cooling capacities, relatively small, are relatively easy to disassemble and repair, are self-regulating and provide a controlled cooling cycle.

A further object of the invention is to provide a novel cryogenic refrigerator comprising a novel form of heat exchanger.

A further more specific object of the invention is to provide an improved refrigerator which is arranged so that the direction of gas flow (injecting or exhausting) is reversed only when the displacer is substantially at the end of its upward or downward stroke, thereby assuring high gas volume transfer through the regenerator and consequently better refrigeration efficiency.

Still another object is to provide a novel cryogenic vacuum pump.

In its preferred embodiment the apparatus of this invention is a two stage refrigerator which includes: cylinder means, displacer means movable within the cylinder means, the displacer means comprising first and second sections which move as a unit, first and second chambers of variable volume defined by the cylinder means and the first and second section respectively of the displacer means, valve means for injecting refrigerant fluid to and removing refrigerant fluid from the first and second chambers, means for establishing a fluid pressure differential across said displacer means as refrigerant fluid moves into and out of said first and second chambers so as to impart predetermined motion to the displacer means, first and second thermal storage means associated with the first and second chambers respectively, first and second heat exchanger means for connecting the first and second chambers to the first and second thermal storage means respectively, and conduit means for connecting the two storage means to the valve means so as to permit flow of fluid between the valve means and the first and second working chambers. The first heat exchanger and the first chamber form one refrigeration stage; the other refrigeration stage comprises the second heat exchanger and the second chamber. The displacer means undergoes controlled reciprocating motion consisting of four steps as follows: (a) dwelling in a first limit position; (b) moving away from that first limit position to a second limit position, (c) dwelling in the second limit position and (d) moving back to the first limit position. The valve means causes high pressure fluid to enter the first and second chambers during two consecutive steps of the displacer motion and exhaust low pressure fluid from the first and second chambers during the two other consecutive steps of the displacer motion. The valve means comprises a reciprocable valve member which is operated solely by the displacer means as it approaches its first and second limit positions. In a second embodiment of the invention an auxiliary conduit means with a selected control valve is provided for selectively interrupting the flow of gas to and from the second chamber and the second thermal storage means, so as to permit an increase in the temperature of the second stage of the refrigerator without reducing the temperature of the first stage of the refrigerator. Other modifications include the provision of two or more thermal storage means connected in parallel with a selected one of the first and second chambers.

Other features and many of the attendant advantages of the invention are described or rendered obvious by the following description of a specific and preferred embodiment of the invention which is to be considered together with the accompanying drawings.

BRIEF DESCRIPTION OF THE DRAWINGS

In the drawings, the same reference characters are used to refer to the same parts throughout the different views. The drawings are not necessarily to scale, emphasis instead being placed upon illustrating principles of the invention in a clear manner.

FIG. 3 is a sectional view taken along line 3—3 of FIG. 1;

FIG. 4 is a schematic view illustrating how the refrigerator may include two or more first and second stage thermal regenerators;

FIG. 5 is a sectional view in elevation showing how the device of FIGS. 1–3 is embodied in a cryogenic pump.

DESCRIPTION OF THE ILLUSTRATED EMBODIMENT OF THE INVENTION

In the following detailed description of the illustrated embodiment of the invention, reference will be made from time to time to upper and lower sections. The terms "upper" and "lower" are used in a relative sense and it is to be understood that the refrigeration apparatus may be oriented in any manner. Hence the terms "upper" and "lower" are employed in this description only to correspond to the orientation illustrated in the figures, which orientation is the one usually encountered in practice. Also, although helium gas is the preferred working fluid, it is to be understood that the present invention may be practiced with other gases according to the refrigeration temperatures that may be desired, including but not limited to air and nitrogen.

Figure 1:
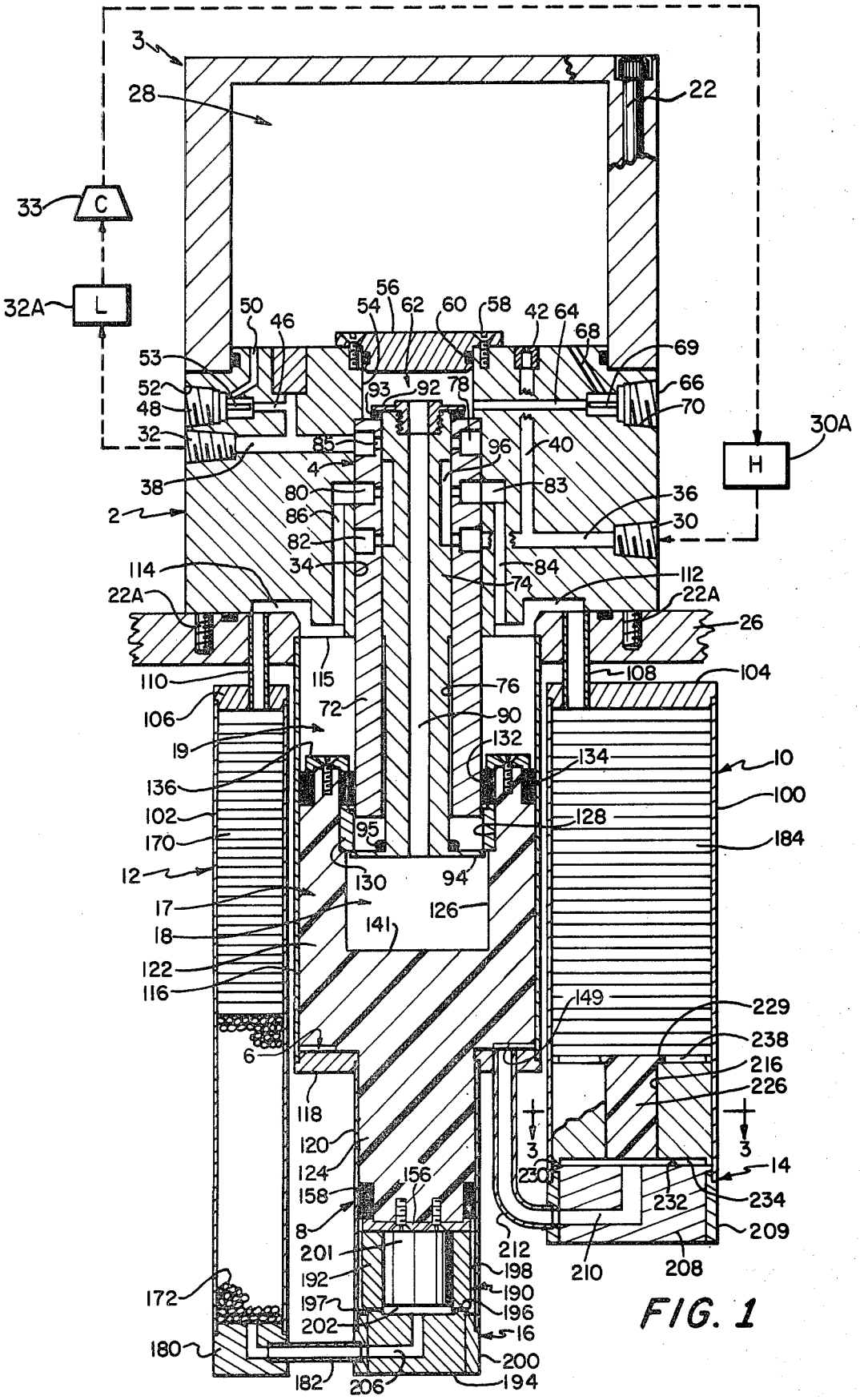
FIG. 1 is an enlarged, partially sectional view, of a preferred embodiment of the invention constituting a Gifford-McMahon cycle cryogenic refrigerator, showing the displacer and control valve mechanisms in a first limit position.
Figure 2:
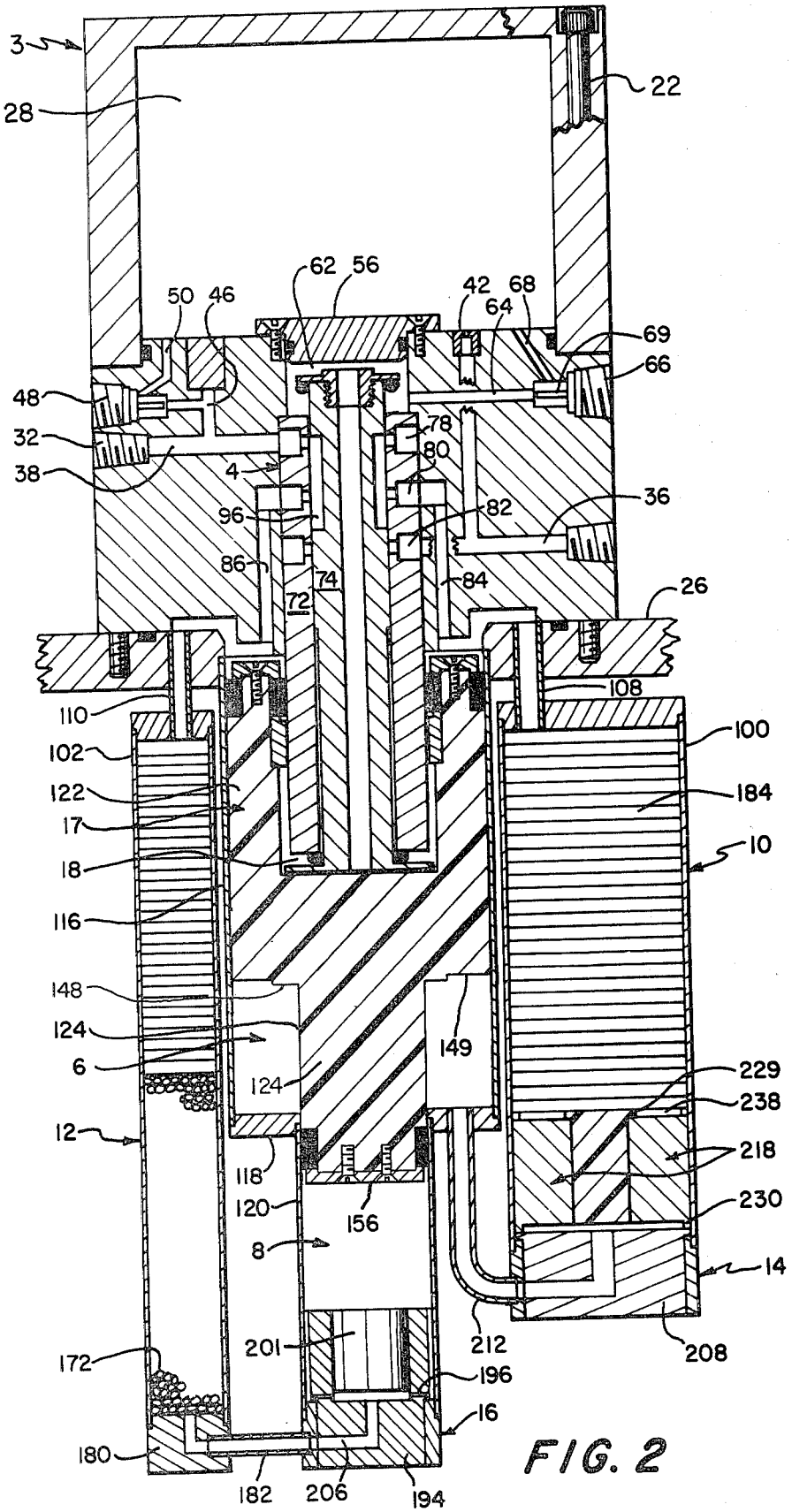
FIG. 2 is a view similar to FIG. 1 illustrating the control valve mechanism and the displacer in a second limit position.

Referring now to FIGS. 1 and 2, the preferred embodiment of the invention comprises a metal header assembly consisting of a header body 2 and a header cap 3. The header body 2 accommodates and supports a control valve 4 which is used to control the flow of a selected refrigerant fluid in gaseous form, e.g. helium, to and from two cooling volume chambers 6 and 8 via two separate thermal regenerators 10 and 12 and two heat exchangers 14 and 16 associated with regenerators 10 and 12 respectively, according to the movement of a displacer means 17. Valve 4 also serves to supply refrigerant fluid at a selected pressure to a drive volume chamber 18 and a chamber 19.

The header body 2 is provided with a plurality of longitudinally extending bores spaced around its periphery for accommodating a plurality of bolts 22 which pass through suitable bores in the header cap 3 and have threaded ends 22A screwed into tapped openings in a suitable support represented generally as a plate 26. The cap member 3 is hollow so as to define an intermediate drive pressure chamber 28 above the header body 2.

The header body 2 is provided with a first port 30 for the introduction of high pressure refrigerant fluid to the refrigerator and a second port 32 for use in exhausting low pressure fluid from the refrigerator. In the usual installation, the refrigerator will have its port 30 connected to a reservoir or source of high pressure fluid 30A and its port 32 connected to a reservoir or source of low pressure fluid 32A. It will, of course, be understood that the lower pressure fluid may exhaust to the atmosphere (open cycle) or may be returned to the system (closed cycle) by way of suitable conduits which lead first into a compressor 33 and then into the high pressure reservoir 30A, in the manner illustrated in FIG. 1 of U.S. Pat. No. 2,966,035. Header body 2 also has a center bore 34 in which is received the control valve 4. The high pressure and low pressure ports 30 and 32 are connected by passageways 36 and 38 to the bore 34. Additionally the passageway 36 is connected by a passageway 40 to chamber 28. Preferably the passageway 40 is provided with an orifice 42 of reduced diameter so as to control the rate at which high pressure fluid may enter the chamber 28. The passageway 38 also is connected by a passageway 46 and an adjustable needle valve 48 to a passageway 50 leading to chamber 28. The needle valve 48 may be of any suitable design and preferably it is an adjustable screw type valve which is mounted in threaded bore 52 in the header body 2. This needle valve has a section 53 which is aligned with the passageway 46 and is arranged so that the effective area of the discharge end of passageway 46 is modified according to the penetration of section 53 into the passageway 46 as determined by rotation of the needle valve in bore 52. Since chamber 28 is connected to both the high and low pressure ports 30 and 32 respectively, needle valve 48 serves to permit adjustment of the pressure in chamber 28 to a level IP between that of the high and low sources 30A and 32A.

Still referring to FIG. 1, the bore 34 has a reduced diameter section 54. The end of this bore section 54 is closed off by a plug 56 which is secured in place by screws 58. Preferably the plug 56 has a peripheral groove to accommodate an O-ring 60 for making a fluid tight seal between the plug and the bore section 54. The plug 56 occupies only a portion of the reduced diameter section 54 of bore 34, thus leaving a chamber 62 above control valve 4. The chamber 62 is connected to the chamber 28 by means in header body 2 consisting of a passageway 64, a needle valve 66, and a passageway 68. The needle valve 66 is similar to the needle valve 48, having a section 69 which is movable by rotation of the valve member in a threaded bore 70. The needle valve section 69 cooperates with the passageway 64 so that the position of section 69 determines the effective area of the inlet end of passageway 64, i.e. where it meets the valve section 69. Needle valve 66 serves to permit adjustment of the operating speed of displacer 17 since it controls the rate at which fluid can flow into or out of drive volume 18.

Still referring to FIG. 1, the valve 4 comprises a valve casing 72 and a slide valve member 74. The casing 72 is located in bore 34 and is fixed to the header body 2 by suitable means, e.g., by a friction fit or by a roll pin (not shown). The valve casing 72 is provided with a center bore 76 in which is slidably mounted the valve member 74. Additionally the valve casing 72 is provided with three circumferentially extending grooves 78, 80 and 82 at its outer surface. The groove 78 is located so as to communicate with the passageway 38. The groove 82 is located so as to communicate with the passageway 36. The groove 80 is located intermediate the groove 78 and 82 and is positioned so as to communicate with an annular groove 83 in header body 2. Groove 83 connects with oppositely disposed passageways 84 and 86 which lead to the thermal regenerators 10 and 12 by means hereinafter described. Preferably at least two passageways 84 and two passageways 86 are used. Each of the grooves 78, 80 and 82 intersects a like number of identical radially extending small openings 85 that intersect center bore 76.

The slide valve member 74 makes a close smooth sliding fit with valve casing 72. Valve member 74 has a center bore 90 which leads from the chamber 62 to the drive volume chamber 18. Additionally the slide valve member is provided with flanges 92 and 94 at its opposite ends, plus grooves adjacent those flanges for accommodating resilient O-rings 93 and 95 respectively. The flanges 92 and 94 are sized so as to overlap the adjacent end surfaces of valve casing 72 and act as shoulders to retain O-rings 93 and 95. The latter are sized and disposed so that they will engage the adjacent end surfaces of valve body 72 when slide valve member 74 is in the positions shown in FIGS. 1 and 2 respectively. The O-rings 93 and 95 determine the two limit positions of valve member 74 and also act as snubbers or cushions to absorb the shock, if any, which occurs when the slide valve member 74 reaches one or the other of its two limit positions.

Additionally, valve member 74 comprises an axially elongate circumferentially-extending groove 96 which is arranged so that (a) when the valve member 74 is disposed in its lower limit position (FIG. 1), groove 96 provides communication between peripheral grooves 80 and 82 while the peripheral groove 78 is blocked off by an adjacent portion of the exterior surface of valve member 74; and (b) when valve member 74 is in its upper limit position (FIG. 2), groove 96 provides communication between the peripheral grooves 78 and 80 while the peripheral groove 82 is blocked off by an adjacent portion of the exterior surface of valve member 74. Accordingly, when the valve member 74 is in its lower limit position, the high pressure port 30 is connected to the passageways 84 and 86 by way of the peripheral grooves 80 and 82; on the other hand when the valve member 84 is in its upper limit position, the passageways 84 and 86 are connected to the low pressure port 32 by way of the peripheral grooves 78 and 80.

Still referring to FIGS. 1 and 2, the regenerators 10 and 12 comprise metal cylinders 100 and 102 having metal upper end walls 104 and 106 which are attached to metal conduits 108 and 110 respectively. The conduits 108 and 110 pass through and are attached to the support plate 26 so as to support the regenerators 10 and 12 respectively. The header body 2 is provided with radially-extending passageways 112 and 114 which connect the passageways 84 and 86 to the conduits 108 and 110 respectively.

Still referring to FIGS. 1 and 2, the header body 2 is provided with a reduced diameter extension 115 which fits into a hole in support plate 26. Secured in the same hole in plate 26 in close fitting relation with extension 115 is a cylinder 116 preferably made of a suitable heat conductive material, e.g., steel. The opposite end of cylinder 116 is closed off by a bottom end wall 118. The latter preferably is made of the same material as cylinder 116 and has a center opening in which is secured a second cylinder 120 of like material. The bottom end of the cylinder 120 is closed off by the heat exchanger 16 which is described in detail hereinafter.

Still referring to FIGS. 1 and 2, the lower end of the valve casing 72 is surrounded by a displacer means 17 consisting of a first (upper) section 122 slidably disposed in cylinder 116 and a second (lower) section 124 slidably disposed in cylinder 120. The upper section 122 has a center bore 126 to accommodate valve casing 72. Bore 126 is oversized with respect to valve casing 72 and is provided with an enlarged diameter section 128 at its upper end. Secured in this upper end section 128 is a metal ring 130 which slidably engages the exterior surface of valve casing 72. Ring 130 is secured to the displacer section 122 by any suitable means. Additionally the displacer means comprises two resilient seals 132 and 134 which are secured in place by means of a retaining ring 136. The latter is held in place by means of screws that are received by tapped holes in the section 122 of the displacer means. The seal 132 provides a slidable seal with respect to the valve casing 72 and also may act to hold ring 130 in place, while the seal member 134 provides a sliding seal with respect to the adjacent surface of the surrounding cylinder 116. The bottom end of displacer section 124 is provided with a retaining ring 156 which holds in place a resilient sealing member 158 that slidably engages cylinder 120 and provides an hermetic seal between the cylinder and section 124. Ring 156 is spaced from cylinder 120 as shown.

As seen in FIGS. 1 and 2, the displacer means is movable between a lower limit position wherein the ring 130 is stopped by flange 94 of valve member 74 when the latter is in its lower limit position, and an upper limit position wherein the surface 141 of section 122 is stopped by flange 94 of the valve member when the latter is in its upper limit position.

The length of displacer section 122 is sized so that its bottom surface 148 engages or stops just short of engaging end wall 118 when the valve member 74 and the displacer section 122 are in their bottom limit positions. To insure rapid flow into and out of chamber 6 via a conduit 212 hereinafter described, a part of the underside 148 of section 122 is undercut or relieved so as to provide a recessed surface 149 which forms a gap between it and end wall 118 when surface 148 engages or nearly engages that end wall.

The thermal regenerator 12 is a two-stage device. A first upper section consists of a plurality of bronze screens represented schematically at 170 which are used to achieve cooling to a temperature of approximately 77 degrees K. The second lower section of the thermal regenerator 12 is filled with a myriad of spherical lead beads represented schematically at 172 which are used to achieve cooling to a temperature of approximately 20 degrees K. The relative lengths of the sections of bronze screens 170 and lead beads 172 is a matter of optimization. Preferably the bronze screens are formed so as to correspond to a 200 mesh screen, while the lead spheres have an average diameter in the order of 0.010–0.012 inch. The regenerator sections 170 and 172 are contained within cylinder 102. The lower end of the cylinder is closed off by a metal end wall 180. This end wall is connected by means of a metal conduit 182 to the heat exchanger 16.

The regenerator 10 consists of a plurality of bronze screens 184 having an average mesh size of 150 mesh contained in cylinder 100. The bottom end of cylinder 102 is closed off by heat exchanger 14.

The heat exchanger 16 comprises a copper plug 190 disposed in the lower end of cylinder 120. Plug 190 has a relatively large diameter upper section 192 and a relatively small diameter lower section 194. The lower, smaller diameter section 194 of copper plug 190 extends within and is secured to a steel ring 200. The latter extends within and is secured to the cylinder 120. The upper section 192 is hollow and is provided with a plurality of radially extending passageways 196 leading through its wall. The outer surface of upper section 192 is spaced from the interior surface of the cylinder 120 so as to leave a narrow annular passageway 198, e.g. about 0.001–0.006 inch, that communicates with the annular gap between the edge of retaining ring 156 and cylinder 120. Additionally plug 190 has a circumferentially extending groove 197 which intersects the passageways 196 and 198. A steel plug 201 is secured within upper section 192 so as to form a space 202 which serves as a manifold for supplying fluid to the radial ports 196 that communicate with the annular passageway 198. At its center the manifold chamber 202 communicates with a passageway 206 in section 194 that leads through a side opening in ring 200 to conduit 182. As a result of the foregoing construction, refrigerant fluid can flow between cooling chamber 8 and thermal regenerator 12 by way of the conduit 182, passageway 206, manifold 202, radial passageways 196, groove 197 and annular passageway 198.

Referring now to FIGS. 1 and 3, the heat exchanger 14 comprises a copper plug 208 whose lower end is surrounded and secured to a steel ring 209 that extends within and is affixed to the bottom end of cylinder 100 of thermal regenerator 10. The plug 208 has a passageway 210 which communicates with a hole in the ring 209. Secured in the hole in ring 209 is one end of a conduit 212. The other end of conduit 212 is secured in a hole in end wall 118. The upper end of plug 208 is surrounded and engaged by sleeve 100 and is provided with a plurality of radial slots or grooves 214 that connect with its relatively large center hole 216. Disposed in each of the radial slots 214 is an insert member 218 which consists of a relatively narrow body portion 220 and a pair of relatively wide end portions 222. The body portion 220 has a thickness substantially less than the width of the grooves 214, while the end sections 222 are sized to engage the opposite sides of grooves 214. These inserts are sized so their outer end portions 222 engage the inner surface of cylinder 100, while their inner sections 222 terminate flush with the inner surface of the plug 208. Mounted within the opening 216 is a rod 226 which engages the inner end sections 222 of the inserts 218 and thereby fully blocks off the bore 216 to passage of fluid. As seen in FIGS. 1 and 2, the outer end sections 222 of the inserts 218 are provided with depending extensions 230 which engage the surfaces 232 forming the bottom of the grooves 214 and thus space the inserts 218 from those surfaces. As a result a manifold chamber 234 is provided which connects the bottom ends of all of the grooves 214 with the passageway 210. The upper end of plug 208 has a counterbore 238 which forms an upper manifold chamber. Rod 226 has a flange 229 which overlies the upper end surface of plug 208 and forms the inner side of chamber 238. Flange 229 and the raised outer portion of the upper end of plug 208 form bottom supports for the screens 184. As a consequence, fluid refrigeration can flow in one direction or the other between the cooling chamber 6 and the thermal regenerator 10 via the conduit 212, passageway 210, manifold 234, grooves 214, and manifold chamber 238.

The plugs 208 and 194 coact with rings 209 and 200 so as to serve as the first and second stage heat exchanger stations respectively. As explained hereinafter, the first stage heat exchanger station is cooled to a temperature of approximately 77 degrees K. while the second stage heat exchanger station is cooled to a temperature of approximately 20 degrees K. In accordance with this invention, the length of the cylinder 120 is such that the second stage heat station 194, 200 is offset axially below the first stage heat station 208, 209.

Movement of the displacer up or down depends on the existence of a differential force produced by the fluid pressures in chambers 6, 8, 18 and 19. The pressure in drive volume 18 remains unchanged so long as the pressure in chamber 28 remains unchanged, while the fluid pressures in chambers 6, 8 and 19 depend on the setting of valve member 74. Considering as negligible the pressure drops across the heat exchangers and thermal regenerators, the pressure in chamber 19 is always substantially the same as the pressure in chambers 6 and 8. Accordingly the differential force across the displacer 17 is the difference between (a) the sum of the product of the pressure in chamber 18 and the area of surface 141 and the product of the pressure in chamber 19 and the effective area of the upper end surface of displacer section 122 in chamber 19, and (b) the sum of the product of the pressure in chamber 6 and the effective area of the undersurfaces 148 and 149 of section 122 and the product of the pressure in chamber 8 and the effective area of the underside (ring 156 and seal 158) of displacer section 124. It is to be noted that when the displacer is in its lower limit position, retaining ring 156 engages or nearly engages the upper end of plug 190. Preferably to minimize noise and extend useful life, surface 148 and ring 156 stop close to but short of wall 118 and plug 190 respectively when the displacer reaches its lower limit position.

Operation of the apparatus disclosed in FIGS. 1–3 will now be described starting with the assumption that the slide valve member 74 is in its bottom limit position (FIG. 1) and displacer 17 is moving upward and is located at the point, just short of its top dead center position (TDC), where its internal surface 141 first engages the bottom end of slide valve member 74.

When the displacer 17 is located just short of its top dead center position as just described, the fluid pressure and the temperature conditions in the refrigerator are as follows: (a) chamber 19 is at high pressure and room temperature; (b) chambers 6 and 8 are at high pressure and low temperature; and (c) chambers 18 and 62 are at an intermediate pressure IP and room temperature. As the displacer continues moving up, the surface 141 engages slide valve member 74 and shifts the latter up to its top limit position (FIG. 2) as the displacer reaches its top dead center position. When the slide valve member moves from its bottom limit position to its top limit position, or vice versa, it moves through a transition point. In this transition point the lower edge of the circumferential groove 96 is even with the upper edges of the ports 85 of groove 82, while the upper edge of the same circumferential groove 96 is even with the lower edges of the ports 85 of groove 78. When the slide valve member passes its transition position, fluid commences to exhaust from the chamber 19 to port 32 via the passages 112 and 114, thus reducing the pressure in the cooling chambers 6 and 8. When the slide valve is in its upper limit position (FIG. 2) and the displacer is in its TDC position, cold high pressure gas in chambers 6 and 8 will exhaust through the regenerators 10 and 12 respectively. As the gas is exhausted it gets heated up by the matrices of the two regenerators, thus cooling the latter. Now because of the lower pressure in the chambers 6 and 8, a new differential force is exerted on the displacer 17, causing it to move down. However, when the displacer starts down, the valve member 74 will remain in its top limit position due to its close fit with valve casing 72 and the influence of the gas streams flowing through its ports 85 connected to passageways 78 and 80. As the displacer moves down, it forces low pressure cold fluid from chambers 6 and 8 and, since the valve member 74 is in its top limit position, valve 4 will continue to exhaust low pressure gas from chambers 6 and 8 via the regenerators. The two regenerators cool down further as they give up heat to the remainder of the cold gas displaced from chambers 6 and 8. The cold gas flowing through the regenerators 10 and 12 expands on heating, thus cooling those regenerators further.

As the displacer 17 nears its bottom dead center (BDC) position, the ring 130 will intercept slide valve member 74 and move it down through its transition position to its bottom limit position (FIG. 1). The displacer stops when valve member 74 reaches its bottom limit position.

When the downwardly moving valve member 74 passes its transition position, high pressure fluid from source 30A will flow into chamber 19 via passageways 84 and 86, thus causing that chamber to be filled with high pressure, low temperature gas which will flow through the two regenerators into the chambers 6 and 8. As the warm gas flows into the chambers 6 and 8, it gets cooled as it passes through the cold regenerators 10 and 12. The increasing pressure in chambers 6 and 8 coupled with the unchanging IP pressure in chamber 18, results in a force differential across the displacer sufficient to cause upward movement of the displacer. As the displacer moves up it causes more high pressure, room temperature gas to flow from the chamber 19 through the regenerators to the chambers 6 and 8, thus cooling this additional gas and causing it to contract in volume. This reduction in volume allows more gas to be sucked from the chamber 19 into the two chambers 6 and 8.

As displacer moves up to its TDC position it again encounters and shifts the slide valve member to its top limit position, thus causing the cycle of operation first described to be repeated. It should be noted that as the displacer reaches its TDC position, the system again will have cold high pressure gas in chambers 6 and 8, room temperature intermediate pressure gas in chamber 18 and room temperature high pressure gas in chamber 19.

The volume of chamber 8 can be substantially less than that of chamber 6 where heat exchanger 16 is smaller than heat exchanger 14. However, since heat exchanger 16 is cooled to about 20 degrees K., it is essential that maximum transfer of fluid into and out of chamber 8 be achieved in order to get maximum cooling efficiency in that stage of the device. The operation of valve 4, which changes states only when the displacer nears its upper or lower limit position, is believed to improve second stage cooling efficiency by allowing enough time for the pressure in the displaced volume 8 to change from low to high on the intake portion of the cycle and from high to low on the exhaust part of the cycle.

Of course, the cooling capacity of the system can be increased by increasing the diameters of displacer sections 122 and 124, whereby to increase the volumes of chambers 6 and 8. Further increases in cooling capacity can be achieved in the manner shown in FIG. 4.

Since the first and second refrigeration stages are in parallel with one another and also because their regenerator/heat exchanger assemblies are spaced radially of one another, the cooling capacity can be increased at relatively moderate expense and relative ease by mounting two or more first refrigeration stages and/or two or more second thermal regenerators to support plate 26 and controlling them by the same control valve/displacer assembly. For example, as shown in FIG. 4, two of the first refrigeration stages, represented schematically by thermal regenerators 10A and B, and two of the second stage regenerators, represented schematically at 12A and B, may be arranged symmetrically about the displacer assembly 17 and controlled by the valve 4. Although not shown, it is to be understood that the apparatus of FIG. 4 will have a pair of diametrically opposed passages 84 displaced ninety degrees from a pair of diametrically opposed passages 86, a pair each of the conduits 108 and 110 connecting passages 84 and 86 to regenerators 10A, 10B and 12A, 12B respectively, two conduits 182 connecting regenerators 12A and B to single heat exchanger 16, and two conduits 212 connecting two heat exchangers 14 with chamber 6. It has been calculated that although only one second stage heat exchanger 16 is present in a dual arrangement of the type represented in FIG. 4 and described above, the cooling capacity may be nearly doubled if the throughput of refrigerant is doubled.

FIG. 5 illustrates application of the invention to a cryopump. Although FIG. 5 is based on the refrigerator of FIGS. 1 and 2, it should be understood that the device of FIG. 5 could have a refrigerator with multiple first and second stage regenerators as suggested in FIG. 4. Except for the refrigerator and the disposition of its heat stations, the cryopump is of conventional construction. It comprises a vessel 248 in the form of a cylinder 250 closed off at one end by support plate 26 and provided at its opposite end with a flange 252. Flange 252 is adapted to be hermetically coupled by bolts 254, nuts 255 and a seal 256 to the flange of a second vessel 258 which may be designed to serve as a working zone in which a load (specimen, sample, electronic component or the like) is maintained at a selected low temperature and pressure. Mounted within vessel 248 is a radiation shield 262 in the form of a cylinder closed on top by an end wall 264 and open at its bottom end. Shield 262 is made of a metal having a high reflectivity and high thermal conductivity. The first stage heat station 208, 209 of the refrigerator engages the upper side of shield wall 264, while the second stage heat station 194, 200 and the lower end of regenerator 12 protrude through holes formed in that end wall. Attached to the shield and extending across its open end is a conventional chevron baffle 266. Located just above chevron 266 and attached to heat station 194, 200 is a cryo-panel 268 which consists of two mutually confronting frusto-conical casings made of a multi-perforated material, e.g., a fine metal screen, and filled with comminuted charcoal. As is believed obvious, the shield 262 and chevron 266 are at the approximately 77 degrees K. temperature of heat station 208, 209, while cryo-panel 268 is at approximately the 20 degrees K. temperature of heat station 194, 200. The vessel 250 (or alternatively the vessel 258) is connected via a valve-controlled line 270 to a rough mechanical vacuum pump 272, and optionally through another valve-controlled line 274 to an ion pump 276.

In the usual operation the chambers of vessels 248 and 258 are initially evacuated by operation of pumps 272 and 276 and then while the latter are still operating, the chambers are cryopumped by condensation of gases on the cold surfaces of chevron 266, cryopanel 268, shield 262 and the exposed surfaces of the heat exchangers 14 and 16. Water vapor freezes out on the 77 degrees K. surfaces, while oxygen and nitrogen solidify on the outer surfaces of 20 degrees K. cryopanel 268. Any noble gases that may be present are absorbed by the charcoal particles in cryopanel 268.

As is known to persons skilled in the art, when the charcoal has become saturated with noble gases, it is necessary to regenerate the charcoal by removing the absorbed gases. This is achieved by warming the cryopanel up to 77 degrees K. or higher so as to vaporize the noble gases and then removing those desorbed gases by the mechanical vacuum pump. Getting a 20 degree K. cryopanel up to 77 degrees K. or higher takes time and in prior devices this operation necessitated shutting down the entire refrigerator, with the result that the 77 degrees K. surfaces also heated up and hence more time was required to get the regenerated cryopanel back down to its desired temperature of about 20 degrees K. This problem is substantially eliminated by the modification shown in FIG. 6.

Figure 6:
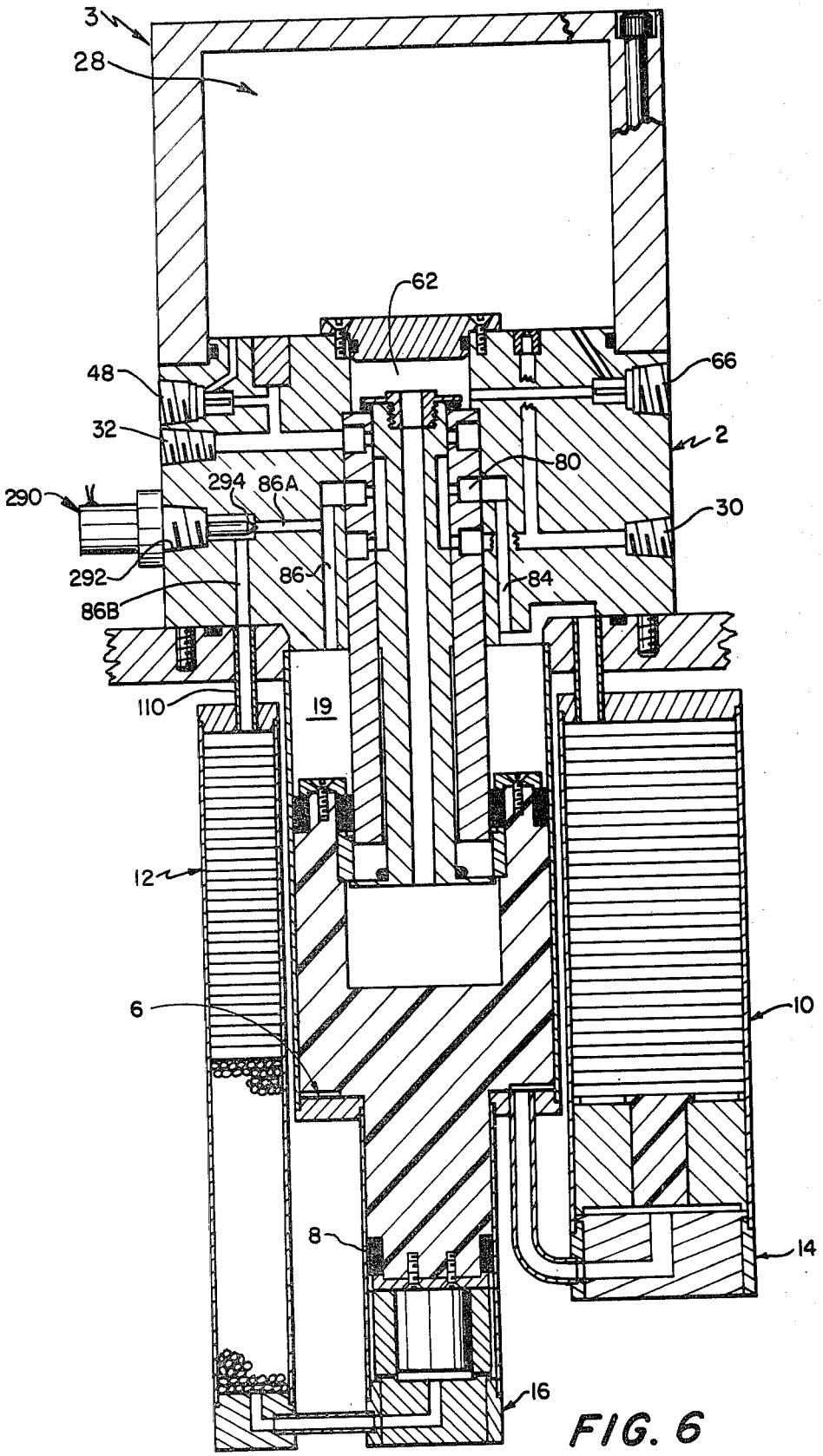
FIG. 6 is a view similar to FIG. 1 of an alternate form of the invention.

The modification of FIG. 6 permits the second stage (regenerator 12 and heat exchanger 16) to be shut down while the first stage is still operating. In this case the header 2 is modified by replacing passageway 114 with two passageways 86A and 86B, and adding a solenoid valve 290 which is mounted in a bore 292 that communicates with passages 86A and 86B. Passageway 86A intersects passageway 86. Valve 290 has a stem with a tapered valve head 294 adapted to engage a seat formed at the outer end of passageway 86A. So long as the solenoid valve is deenergized, fluid can flow between groove 80 and pipe 110 via passages 86A, bore 292 and passage 86B. When the valve is energized, valve head 294 is extended far enough to fully engage its seat and shut off flow of fluid to and from regenerator 12. However, the displacer and the first refrigeration stage will continue to operate since fluid can flow to and from chamber 19 and regenerator 10 via passageway 84 (passageway 86 also conducts fluid to chamber 19). As a result heat station 208 will remain at about 77 degrees K. while heat station 194 will rise to about the same temperature. Once the cryopanel 268 has been regenerated, cooling of heat station 194 is resumed by deenergizing solenoid valve 290.

The invention has many obvious advantages in addition to those already noted, including the fact that the construction may be varied in a number of ways to suit available manufacturing techniques and performance requirements. The two heat exchangers are simple, reliable and efficient. Heat exchanger 14 is especially advantageous since the use of inserts 218 in grooves 214 makes it easy to provide relatively narrow gaps on opposite sides of the inserts (e.g. about 0.004–6 inch). Without the use of inserts 218, it would be difficult and expensive to make grooves 214 narrow enough to provide high efficiency cooling of the gaseous refrigerant.

Still another advantage resides in the fact that the displacer 17 may be made of plastic (as shown in the drawings) or metal. A preferred plastic material is polypropylene. A plastic displacer offers the advantage that it can be molded and is light weight.

Of course the invention may be practiced otherwise than as shown. Thus, for example, it is possible to make heat exchanger 16 like heat exchanger 14, or vice versa. Some other form of heat exchanger also may be employed in place of heat exchanger 14 or 16 or both. Furthermore for some applications the inserts 218 may be omitted and the slots 214 made narrow enough to serve the intended purpose. Still other modifications will be obvious to persons skilled in the art.

What is claimed is:

1. In a cryogenic refrigerator in which (a) fluid under pressure is cooled by heat exchange and expansion in the course of its being transferred into and out of a chamber of variable volume via a thermal regenerator, (b) transfer of the fluid is achieved by reciprocal movement of displacer means and (c) a cyclically operating valve means controls introduction of high pressure fluid to and discharge of low pressure fluid from the chamber, the improvement comprising a displacer means having first and second displacer sections, means cooperating with said displacer means so as to define first, second and third chambers of variable volume, a control valve means comprising a valve casing and a valve member slidably mounted to said valve casing, said valve casing having a high pressure inlet port, a low pressure outlet port, and at least one transfer port, said valve member being movable between predetermined first and second limit positions and being arranged so that it alternately connects said inlet and outlet ports to said transfer port when in said first and second limit positions respectively, said valve also including means for transmitting fluid under pressure to said third chamber, first and second regenerator means connected to transfer fluid between said transfer port and said first and second chambers respectively, heat exchanger means for exchanging heat with the fluid transferred to said first and second chambers respectively, and means for (a) causing said valve member to be shifted to said first limit position by said displacer means as said displacer means moves in a first direction and (b) causing said valve member to be shifted to said second limit position by said displacer means as said displacer means moves in a second opposite direction.

2. A cryogenic refrigerator according to claim 1 wherein said first and second chambers of variable volume are formed in part by said first and second displacer sections respectively.

3. A cryogenic refrigerator comprising a reciprocal displacer means, means cooperating with said displacer means so as to define three chambers of variable volume, the first and second of said chambers increasing in volume as said displacer means moves in a first direction and the third of said chambers increasing in volume as said displacer means moves in a second opposite direction, means defining a high pressure gas inlet port and a low pressure gas outlet port, first and second thermal regenerator means arranged so as to conduct fluid to and from said first and second chambers respectively, first and second heat exchanger means for exchanging heat with fluid moving to and from said first and second chambers respectively, means for feeding a fluid under pressure to said third chamber, and control means for connecting said inlet port to said first and second thermal regenerators when said displacer means moves in one direction to a first selected position and for connecting said outlet port to said first and second thermal regenerators when said displacer means moves in another opposite direction to a second selected position, said displacer means being arranged so as to move in a first direction when the fluid pressure in said first and second chambers exceeds the fluid pressure in said third chamber and to move in a second opposite direction when the fluid pressure in said third chamber exceeds the fluid pressure in said first and second chambers.

4. A cryogenic refrigerator according to claim 3 wherein said displacer means comprises first and second sections and said first and second chambers are defined in part by said first and second sections respectively.

5. A cryogenic refrigerator according to claim 3 wherein said control means is a slide valve.

6. A cryogenic refrigerator according to claim 5 wherein said slide valve comprises said means for feeding a fluid under pressure to said third chamber.

7. A cryogenic refrigerator according to claim 6 wherein said slide valve comprises a valve casing and a valve member, said valve casing having first and second ports connected to said inlet and outlet ports respectively and a third port, said valve member being movable in said valve casing between first and second limit positions and having means for connecting said third port to said first and second ports when in said first and second limit positions respectively; and further including means connecting said third port to said first and second regenerator means respectively.

8. A cryogenic refrigerator according to claim 6 wherein said slide valve has first and second ports connected to said inlet and outlet ports respectively and means for connecting said first and second regenerator means to said first or second ports according to whether said displacer means moves to said first or second selected position.

9. A cryogenic refrigerator according to claim 8 wherein said slide valve includes means for connecting said third chamber to a source of pressurized fluid.

10. A cryogenic refrigerator according to claim 8 further including means defining a fourth chamber connected to said inlet and outlet ports, and means connecting said fourth chamber to said third chamber.

11. A cryogenic refrigerator according to claim 8 having means connecting said inlet and outlet ports to said third chamber so that the fluid pressure in said third chamber is intermediate the fluid pressure at said first and second ports.

12. A cryogenic refrigerator according to claim 3 wherein at least one of said first and second heat exchanger means is attached to and supported by one of said first and second thermal regenerators.

13. A cryogenic refrigerator according to claim 3 wherein said first and second thermal regenerators are disposed eccentrically of said displacer means.

14. A cryogenic refrigerator according to claim 13 wherein said first and second heat exchanger means are offset from one another in a direction parallel to the axis of said displacer means, and one of said heat exchanger means is displaced radially from said axis.

15. A cryogenic refrigerator according to claim 3 wherein one of said heat exchanger means comprises a block of heat conductive material having opposite ends and a plurality of slots therein defining a plurality of narrow passageways for fluid, said passageways extending between said opposite ends, means for passing fluid between said narrow passageways and one of said regenerator means, and means for passing fluid between said narrow passageways and one of said first and second chambers.

16. A cryogenic refrigerator according to claim 15 wherein said one heat exchange means comprises a second block of heat conductive material, and said means for passing fluid between said narrow passageways and one of said chambers comprises a passageway in said second block.

17. A cryogenic refrigerator according to claim 3 further including auxiliary valve means for selectively terminating flow of fluid between said inlet port and one of said first and second thermal regenerators, whereby said one thermal regenerator may be shut down while the other is still operating.

18. A cryogenic refrigerator according to claim 3 wherein each of said thermal regenerators contains a matrix of a heat conductive material and the matrix of one regenerator has a greater heat transfer capacity than the matrix of the other regenerator.

19. A cryogenic refrigerator according to claim 3 combined with other components so as to form a cryogenic pump, said components comprising a housing, a chevron mounted in said housing, a radiation shield at least partially surrounding said chevron, and a cryopanel attached to one of said heat exchanger means between said heat shield and said chevron, the other of said heat exchanger means being in conductive contact with said radiation shield.

20. A cryogenic refrigerator comprising:

a displacer having first and second sections of different diameters;

first and second housings slidably accommodating said first and second displacer sections and cooperating therewith so as to form first and second chambers of variable volume respectively, first and second heat exchanger sections in heat conducting relation with said first and second chambers respectively, said first and second heat exchangers being adapted to conduct a fluid refrigerant to and from said first and second chambers respectively;

first and second thermal regenerator means each adapted to accommodate throughflow of a fluid refrigerant;

means connecting said first and second thermal regenerator means to said first and second heat exchangers respectively; and valve means for controlling flow of refrigerant to and from said first and second heat exchangers via said first and second thermal regenerator means respectively, said valve means comprising a slidable valve member connected to said first displacer section by a lost-motion connection and cooperating therewith to define a third variable volume chamber, said valve member being movable between a first limit position wherein it feeds a refrigerant fluid under pressure to said first and second chambers via said first and second regenerator means respectively, and a second limit position wherein it exhausts a refrigerant fluid from said first and second chambers via said first and second regenerator means respectively, at least one of said heat exchangers being located eccentrically of said displacer.

21. A cryogenic refrigerator according to claim 20 wherein said displacer is free to be moved by a fluid force differential, and said valve member is adapted to control the pressure in said third chamber so that said displacer will reciprocate in said housings according to the fluid pressures in said first, second and third chambers.

* * * * *